United States Patent [19]

Parker et al.

[11] 4,392,343

[45] Jul. 12, 1983

[54] FRICTION SPINNING APPARATUS

[76] Inventors: Alan Parker, 7 Darvel Close, Breightmet, Bolton, Lancashire; William M. Farnhill, 335 Colne Rd., Burnley, Lancashire; Douglas O. Clough, 26 Parkwood Dr., Rawtenstall, Rossendale, Lancashire, all of England

[21] Appl. No.: 308,955

[22] Filed: Oct. 6, 1981

[30] Foreign Application Priority Data

Oct. 8, 1980 [GB] United Kingdom ..... 8032417

[51] Int. Cl.[3] ..... D01H 7/882

[52] U.S. Cl. ..... 57/401; 57/411; 57/413

[58] Field of Search ..... 57/401, 405, 408, 411–413, 57/417

[56] References Cited

U.S. PATENT DOCUMENTS

| | | | |
|---|---|---|---|
| 3,685,267 | 8/1972 | Landwehrkamp et al. | 57/405 X |
| 4,168,601 | 9/1979 | Didek et al. | 57/401 |
| 4,202,163 | 5/1980 | Turk et al. | 57/401 |
| 4,241,574 | 12/1980 | Turk et al. | 57/401 X |
| 4,249,368 | 2/1981 | Fehrer | 57/401 X |
| 4,315,398 | 2/1982 | Parker et al. | 57/401 |
| 4,327,545 | 5/1982 | Fehrer | 57/401 X |

*Primary Examiner*—John Petrakes

*Attorney, Agent, or Firm*—Donald H. Feldman

[57] ABSTRACT

A friction spinning apparatus including two rollers defining between them an elongate yarn formation area from which yarn is drawn axially of the rollers, has a fibre feed duct extending to a position between the rollers and closely adjacent the yarn formation area. The fibre feed duct includes a surface along each side adjacent the respective roller which surface is curved to follow the curvature of the adjacent portion of the roller.

6 Claims, 2 Drawing Figures

FRICTION SPINNING APPARATUS

Figure 1:
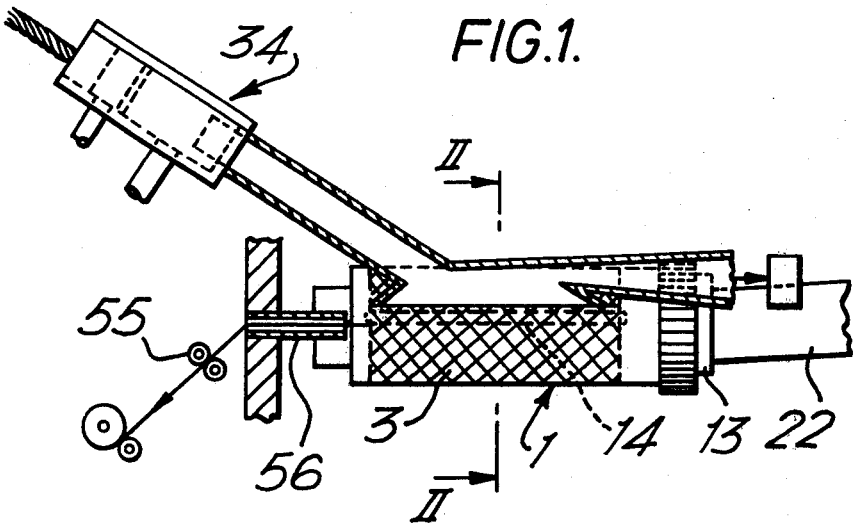

This invention relates to apparatus for the open end spinning of yarn and particularly to apparatus of the kind known as friction spinning.

Apparatus of this kind is disclosed in published British Application No. 2,042,599 of Platt Saco Lowell (corresponding to U.S. Pat. No. 4,315,398 of Feb. 6, 1982) and comprises two rollers each defining a surface and arranged such that the surfaces lie closely adjacent at a line of closest approach so as to define between them an elongate throat which narrows toward the line of closest approach, a feed duct for feeding fibres into the throat which feed duct terminates within the throat and adjacent the line in an elongate mouth substantially parallel to the line and spaced from the line a distance less than the radius of curvature of each of the bodies, means for rotating each of the bodies about a respective axis so as to twist the fibres in the area into a yarn, and means for withdrawing the yarn from the area.

Similar apparatus is disclosed in various patents and patent applications assigned to or filed by Barmag Barmer Maschinenfabrik AG and by Dr. Ernst Fehrer.

In all these arrangements at least one of the rollers is perforated and suction means is provided within the roller for developing an airstream through the surface of the roller. The extent of the airstream over the surface is delineated by an internal sleeve with a slot.

However in none of these patents and applications has the importance been appreciated of the air currents and air flow in the small zone adjacent the area of yarn formation. It is now noted that this area is of paramount importance in respect of air currents both from the point of view of suction losses and of improvement in spinning performance.

In U.S. Pat. No. 4,202,163 (Turk et al.) Barmag attempt to reduce suction losses by placing the spinning unit in a sealed box but this solution has been found to be unsatisfactory.

In an alternative arrangement, peculiar to themselves and disclosed for example in U.S. Pat. No. 4,168,601, Vyzkumny Ustav Bavlnarsky (Didek et al.) provide an arrangement wherein the feed duct does not extend into the throat but feeds fibres onto only one of the surfaces at a position remote from the yarn formation area and wherein the airstream through the surface is delineated externally of the roller by a portion of the feed duct. This arrangement is very different from those of Platt Saco Lowell, Barmag and Fehrer and is unsatisfactory in that it does not provide proper control of the fibres as they are fed into the forming yarn.

The invention is concerned only with the general type of apparatus defined above, as opposed to that of VUB, and provides that the feed duct includes two surfaces each lying along a respective side of the mouth and arranged closely adjacent to a respective body surface and each being curved in a direction away from the mouth so as to follow the curvature of the adjacent portion of body surface.

The invention will become more apparent from the following description when taken in conjunction with the accompanying drawings in which:

FIG. 1 is taken from the published Application No. 2,042,599 U.S. Pat. No. 4,315,398 of Feb. 6, 1982) and shows schematically a friction spinning apparatus of the above defined type.

Figure 2:
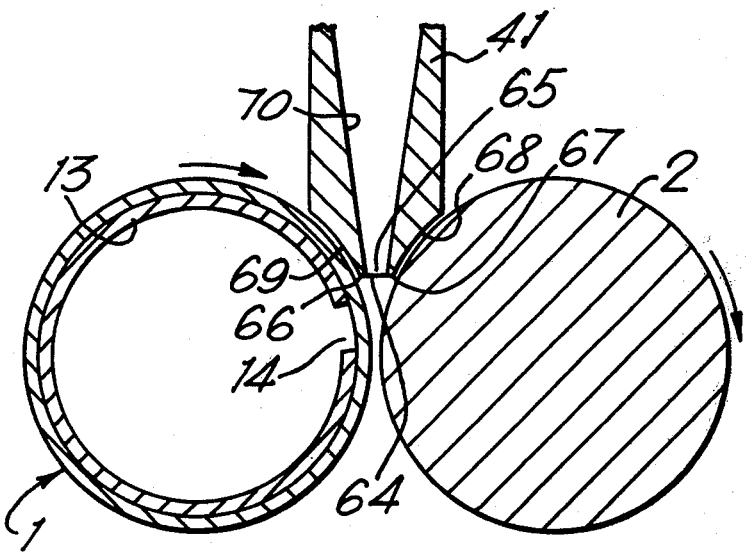

FIG. 2 is a cross-section taken along the lines II—II of FIG. 1 showing a feed duct and roller arrangement according to the invention.

Referring firstly to FIG. 1, the structure and operation of this apparatus is more fully disclosed and described in British Patent Application No. 2,042,599. Very briefly the apparatus comprises a pair of rollers 1, 2, one of which, roller 1, has a perforated surface as shown at 3 and the other 2 is imperforate. The rollers are mounted and arranged to lie closely adjacent at a line of closest approach so as to form a cusp shaped elongate throat between them which narrows toward the line of closest approach. Inside roller 1 is mounted a sleeve 13 which defines an elongate slot 14 lying along the perforated surface 3 adjacent the line of closest approach and closely adjacent the surface 3. The sleeve 13 is connected to a source of suction 22 so that air is drawn into the sleeve through the surface 3 of the roller 1 over an area delineated by the slot 14.

The apparatus described in British Patent Application No. 2,042,599 has been here modified by the provision of a modified feed duct 41 as shown in FIG. 2. The present feed duct 41 terminates within the throat closely adjacent the line of closest approach of the rollers 1 and 2 in a face 64 extending along the rollers and substantially parallel to the line and including a mouth 65 and two surfaces 66, 67 substantially co-planar with the mouth. The mouth is spaced from the line by less than the diameter of the rollers so that the face 4 defines, with the adjacent surfaces of the rollers 1 and 2 a small confining zone within which the fibres are fed and the yarn is formed. The mouth 64 communicates with a bore 70 cut inside the body of the feed duct through which fibres are transported as fully described in the aforementioned patent application from an opening roller and fibre feed system shown schematically at 34.

Extending from the face 64 the duct 41 includes two surfaces 68, 69 which extend along either side of the feed duct along its full length. The surfaces 68 and 69 are curved or concave so as to follow the curvature of the adjacent portion of the rollers 1 and 2. In the embodiments shown the rollers are cylindrical and of the same diameter and hence the surfaces 68 and 69 are also part cylindrical of substantially the same radius of curvature as the rollers. In other embodiments, different shapes of roller may be used.

The width of the mouth 65 is at most 3 mm and preferably in the range 1 to 2 mm. The surfaces 66 and 67 either side of the mouth are narrow so that the face 64 is less than 5 mm wide. The gap between the rollers and the surfaces 68 and 69 is at most 0.5 mm and preferably of the order of 0.25 mm. In this way the mouth 65 is arranged effectively close to the line of closest approach so as to define a small area within which the yarn is formed.

Furthermore, the amount of air flowing into the small area between the sides of the feed duct and the rollers is substantially reduced and is closely controlled so as to reduce the amount of air flow necessary to cause the required air flow through the feed duct and to provide the optimum conditions of air currents within the small area.

The fibres are fed directly into the yarn formation area from the feed duct 41. The rollers 1 and 2 are rotated about their axes by the pulley 32 and a corresponding pulley (not shown) on the roller 2 in the direction shown by arrows so as to twist the fibres in the yarn formation zone to form a yarn. The yarn is withdrawn from the zone axially of the rollers through a duct 56 by delivery rollers 55 and packaged.

What we claim is:

1. Apparatus for open end spinning of yarns comprising two bodies of rotation each defining a surface and arranged such that the surfaces lie closely adjacent at a line of closest approach so as to define between them an elongate throat which narrows toward the line of closest approach, at least one of the surfaces being perforated, means defining a slot adjacent said at least one surface, suction means for drawing air through that portion of the surface delineated by the slot, a feed duct for feeding fibres into the throat, the feed duct terminating within the throat and adjacent the line in an elongate mouth substantially parallel to the line and spaced from the line a distance less than the radius of curvature of each of the bodies and including two surfaces each lying along a respective side of the mouth and arranged closely adjacent to a respective body surface and each being curved in a direction away from the mouth so as to follow the curvature of the adjacent portion of body surface and be separated therefrom by a gap distance of at most 0.5 mm., means for rotating each of the bodies about a respective axis so as to twist the fibres in the area into a yarn, and means for withdrawing the yarn from the area.

2. Apparatus according to claim 1, wherein the body surfaces are formed by the outside peripheral surfaces of two rollers of substantially the same size.

3. Apparatus according to claim 1, wherein the gap is of the order of 0.25 mm.

4. Apparatus according to claim 1, wherein the feed duct includes two further surfaces substantially co-planar with the mouth and extending from the mouth to the curved surfaces.

5. Apparatus according to claim 4, wherein the width of the feed duct across the further surfaces and the mouth is at most 5 mm.

6. Apparatus according to claim 1, wherein the width of the mouth is at most 3 mm.

* * * * *